US011137216B2

(12) United States Patent
Xu et al.

(10) Patent No.: US 11,137,216 B2
(45) Date of Patent: Oct. 5, 2021

(54) REGENERATOR MATERIAL AND REGENERATIVE REFRIGERATOR

(71) Applicant: Sumitomo Heavy Industries, Ltd., Tokyo (JP)

(72) Inventors: Mingyao Xu, Tokyo (JP); Tian Lei, Tokyo (JP); Akihiro Tsuchiya, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 935 days.

(21) Appl. No.: 14/308,077

(22) Filed: Jun. 18, 2014

(65) Prior Publication Data

US 2014/0374054 A1 Dec. 25, 2014

(30) Foreign Application Priority Data

Jun. 20, 2013 (JP) ..... JP2013-129461
Dec. 13, 2013 (JP) ..... JP2013-257721

(51) Int. Cl.
*F28D 17/02* (2006.01)
*F25B 9/14* (2006.01)
(Continued)

(52) U.S. Cl.
CPC ..... *F28D 17/02* (2013.01); *F25B 9/14* (2013.01); *F25B 9/00* (2013.01);
(Continued)

(58) Field of Classification Search
CPC ..... F28D 17/02; F28D 17/023; F28D 19/047; F28D 2020/0008; F28D 2020/0017;
(Continued)

(56) References Cited

U.S. PATENT DOCUMENTS 4,619,112 A * 10/1986 Colgate ..... F02G 1/0445 60/526
5,332,029 A * 7/1994 Tokai ..... F02G 1/0445 165/4
(Continued)

FOREIGN PATENT DOCUMENTS

JP S61-152751 U 9/1986
JP H05-030135 U 4/1993
(Continued)

OTHER PUBLICATIONS

A. Waldauf, T. Kottig, S. Moldenhauer, M. Thurk and P. Seidel, "Improved Cooling Power by Means of a Regenerator Made from Lead Wire Mesh", Cryocoolers 13, pp. 389-394 (6 sheets), Science+Business Media, Inc., New York, 2004.

*Primary Examiner* — Frantz F Jules
*Assistant Examiner* — Webeshet Mengesha
(74) *Attorney, Agent, or Firm* — Michael Best & Friedrich LLP

(57) ABSTRACT

A first-stage regenerator material and a second-stage regenerator material are regenerator materials each having a laminated structure for use in a GM refrigerator. Each layer of the regenerator material is provided with a plurality of holes to allow gas to pass therethrough along a laminating direction. At least one layer includes a base material and a coating covering the base material. Volumetric specific heat of the coating is larger than volumetric specific heat of the base material in a temperature range from 20 K to 40 K.

24 Claims, 14 Drawing Sheets

(51) Int. Cl.
*F28D 19/04* (2006.01)
*F28D 20/00* (2006.01)
*F25B 9/00* (2006.01)

(52) U.S. Cl.
CPC ..... *F25B 2309/003* (2013.01); *F28D 17/023* (2013.01); *F28D 19/047* (2013.01); *F28D 2020/0008* (2013.01)

(58) Field of Classification Search
CPC ..... C22C 12/00; C22C 13/00; C22C 18/00; F25D 3/00; Y02P 20/124; F25B 2309/003; F25B 9/00; F25B 2309/1415–1416; F25B 2309/023
See application file for complete search history.

(56) References Cited

U.S. PATENT DOCUMENTS 6,131,644 A * 10/2000 Kohara ..... F02G 1/057 165/10
6,475,935 B1 * 11/2002 Ishizaki ..... C09K 5/14 442/187
9,134,048 B2 9/2015 Matsubara
2005/0011632 A1 * 1/2005 Tanaka ..... F02G 1/057 165/4
2008/0104967 A1 * 5/2008 Satoh ..... C22C 9/00 62/6
2011/0126553 A1 * 6/2011 Ball-DiFazio ..... F04B 37/08 62/6
2011/0173995 A1 * 7/2011 Takayama ..... G01R 33/3804 62/6

FOREIGN PATENT DOCUMENTS

| | | | |
|---|---|---|---|
| JP | H06-101915 | A | 4/1994 |
| JP | H10-205901 | A | 8/1998 |
| JP | 2002-206816 | A | 7/2002 |
| JP | 2002-228286 | A | 8/2002 |
| JP | 2004-225920 | A | 8/2004 |
| JP | 2004-293998 | A | 10/2004 |
| JP | 2004-333053 | A | 11/2004 |
| JP | 2005-075963 | A | 3/2005 |
| JP | 2006-242484 | A | 9/2006 |
| JP | 2007-132655 | A | 5/2007 |
| JP | 2011-137632 | A | 7/2011 |
| JP | 2011-522198 | A | 7/2011 |
| JP | 2011-190953 | A | 9/2011 |
| JP | 5127226 | B2 | 1/2013 |
| TW | 201241382 | A | 10/2012 |
| WO | WO-2006/022297 | A1 | 3/2006 |

* cited by examiner

30

REGENERATOR MATERIAL AND REGENERATIVE REFRIGERATOR

BACKGROUND OF THE INVENTION

1. Field of the Invention

The present invention relates to a regenerator material and a regenerative refrigerator including the regenerator material.

2. Description of the Related Art

Regenerative refrigerators such as a Gifford-McMahon (GM) refrigerator, a pulse tube refrigerator, a Stirling refrigerator, and a Solvay refrigerator can cool an object in a range from a low temperature of about 100 K (kelvin) to a cryogenic temperature of 4 K. Such a regenerative refrigerator is used for cooling a superconducting magnet, a detector, and the like, a cryopump, and the like.

For example, in the GM refrigerator, working gas such as helium gas compressed in a compressor unit is guided to a regenerator unit and is precooled by a regenerator material in the regenerator unit. The precooled working gas is adiabatically expanded in an expansion chamber thus to further lower a temperature thereof. The low temperature working gas passes through the regenerator unit again and returns to the compressor unit. At this time, the working gas passes through the regenerator unit while cooling the regenerator material in the regenerator unit for working gas to be guided subsequently. With this procedure as one cycle, cyclic cooling is performed.

SUMMARY OF THE INVENTION

One embodiment of the present invention relates to a regenerator material for use in a regenerative refrigerator. The regenerator material comprising a laminated structure, each layer of the laminated structure provided with a plurality of holes to allow gas to pass therethrough along a laminating direction. At least one layer of the laminated structure includes a base material and a coating covering the base material. Volumetric specific heat of the coating is larger than volumetric specific heat of the base material in a temperature range from 20 K to 40 K, except a case in which the coating consists primarily of bismuth.

Another embodiment of the present invention also relates to a regenerator material for use in a regenerative refrigerator. The regenerator material comprising a laminated structure, each layer of the laminated structure provided with a plurality of holes to allow gas to pass therethrough along a laminating direction. At least one layer of the laminated structure is provided with a coating made of an alloy of bismuth and tin, an alloy of antimony and tin, or an alloy of bismuth, antimony, and tin.

Still another embodiment of the present invention relates to a regenerative refrigerator including the aforementioned regenerator material.

Optional combinations of the aforementioned constituting elements, and implementations of the invention in the form of methods, apparatuses, and systems, may also be practiced as additional modes of the present invention.

BRIEF DESCRIPTION OF THE DRAWINGS

Embodiments will now be described, byway of example only, with reference to the accompanying drawings that are meant to be exemplary, not limiting, and wherein like elements are numbered alike in several figures, in which.

DETAILED DESCRIPTION OF THE INVENTION

Figure 1:
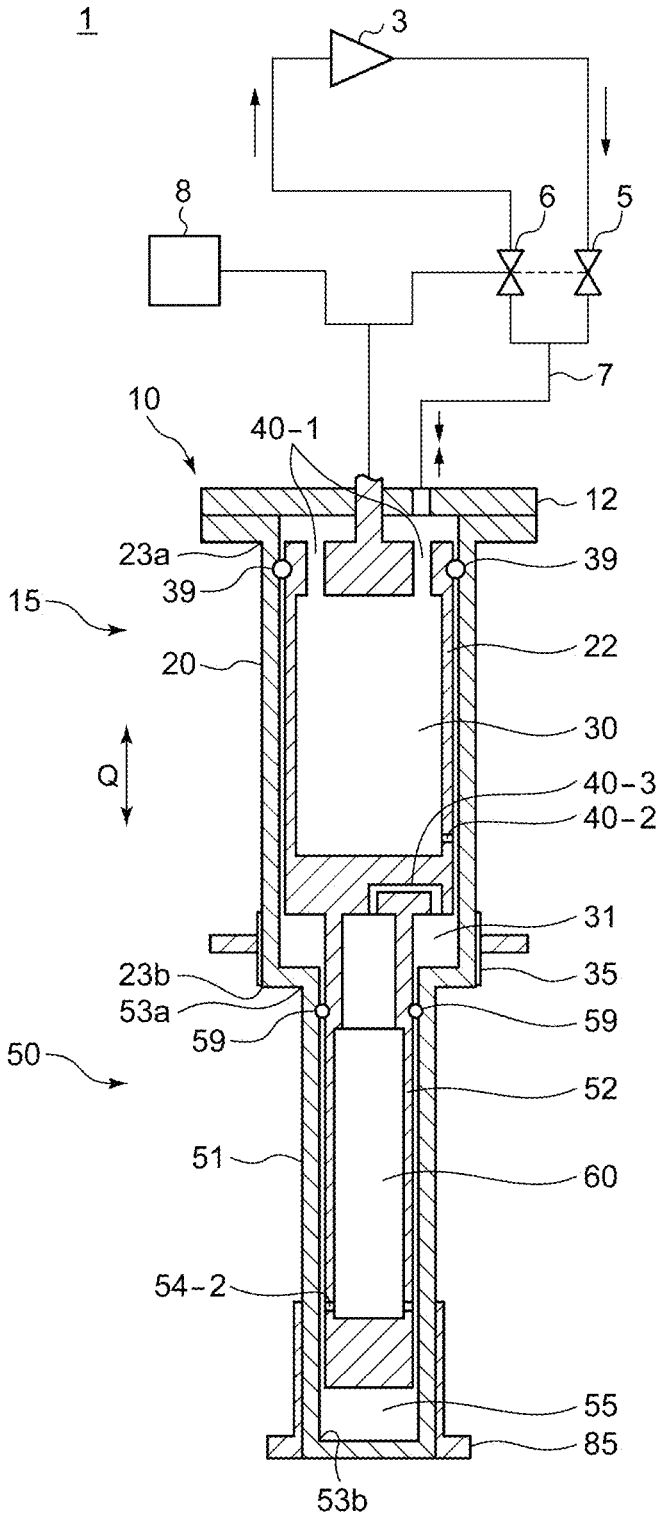
FIG. 1 is a schematic configuration of a GM refrigerator having built therein a regenerator material according to an embodiment.

The invention will now be described by reference to the preferred embodiments. This does not intend to limit the scope of the present invention, but to exemplify the invention.

Hereinbelow, similar or identical components and members illustrated in respective drawings may be shown with the same reference numerals, and description of the duplicate components and members may be omitted as needed. And also, dimensions of the members in the respective drawings may be shown to be enlarged or shrunk as needed to facilitate understanding. In addition, in the respective drawings, some of the members that may not be important in description of embodiments may be omitted.

In the regenerative refrigerator, a heat exchange efficiency of the regenerator material significantly influences refrigerating capacity of the refrigerator. For example, the present applicant conventionally proposed, in Japanese Patent Application Laid-Open No. 2006-242484, forming of a regenerator material by laminating metal meshes to which bismuth is applied or plated.

Since volumetric specific heat of the bismuth in a low temperature range is relatively large, using the bismuth can enlarge heat capacity of the regenerator material in the low temperature range. However, plating the bismuth is technically difficult or would require trouble and cost if it were successful.

An exemplary purpose of an embodiment of the present invention is to provide a regenerator material enabling to increase a heat exchange efficiency and a regenerative refrigerator including the regenerator material.

<GM Refrigerator>

FIG. 1 is a schematic configuration of a GM refrigerator 1 having built therein a regenerator material according to an embodiment. The GM refrigerator 1 includes a gas compressor unit 3 and a two-stage cold head 10 functioning as a refrigerator. The cold head 10 includes a first-stage cooling section 15 and a second-stage cooling section 50, and these cooling sections are connected to be coaxial with a flange 12.

The first-stage cooling section 15 includes a hollow-centered first-stage cylinder 20, a first-stage displacer 22 provided to enable reciprocating movement in an axial direction Q in this first-stage cylinder 20, a first-stage regenerator material 30 according to the embodiment filled in the first-stage displacer 22, a first-stage expansion chamber 31 provided inside the first-stage cylinder 20 on a side of a low temperature end 23*b* and changing a volume thereof by the reciprocating movement of the first-stage displacer 22, and a first-stage cooling stage 35 provided around the low temperature end 23*b* of the first-stage cylinder 20. Between an inner wall of the first-stage cylinder 20 and an outer wall of the first-stage displacer 22 is provided a first-stage seal 39.

A high temperature end 23*a* of the first-stage cylinder 20 is provided with a plurality of first-stage high-temperature-side flow paths 40-1 to let helium gas flow in and out of the first-stage regenerator material 30. In addition, the low temperature end 23*b* of the first-stage cylinder 20 is provided with a plurality of first-stage low-temperature-side flow paths 40-2 to let helium gas flow in and out of the first-stage regenerator material 30 and the first-stage expansion chamber 31.

The second-stage cooling section 50 has an approximately similar configuration to that of the first-stage cooling section 15 and includes a hollow-centered second-stage cylinder 51, a second-stage displacer 52 provided to enable reciprocating movement in the axial direction Q in the second-stage cylinder 51, a second-stage regenerator material 60 according to the embodiment filled in the second-stage displacer 52, a second-stage expansion chamber 55 provided inside the second-stage cylinder 51 on a side of a low temperature end 53*b* and changing a volume thereof by the reciprocating movement of the second-stage displacer 52, and a second-stage cooling stage 85 provided around the low temperature end 53*b* of the second-stage cylinder 51. Between an inner wall of the second-stage cylinder 51 and an outer wall of the second-stage displacer 52 is provided a second-stage seal 59. A high temperature end 53*a* of the second-stage cylinder 51 is provided with a second-stage high-temperature-side flow path 40-3 to let helium gas flow in and out of the second-stage regenerator material 60. In addition, the low temperature end 53*b* of the second-stage cylinder 51 is provided with a plurality of second-stage low-temperature-side flow paths 54-2 to let helium gas flow in and out of the second-stage expansion chamber 55.

In the GM refrigerator 1, high-pressure helium gas from the gas compressor unit 3 is supplied via a high-pressure valve 5 and a pipe 7 to the first-stage cooling section 15 while low-pressure helium gas is exhausted from the first-stage cooling section 15 via the pipe 7 and a low-pressure valve 6 to the gas compressor unit 3. The first-stage displacer 22 and the second-stage displacer 52 perform reciprocating movement along the axial direction Q by a driving motor 8. And also, interlocking with this, opening/closing of the high-pressure valve 5 and the low-pressure valve 6 is performed to control timing of intake and exhaust of helium gas.

The high temperature end 23*a* of the first-stage cylinder 20 is set at a room temperature, for example, and the low temperature end 23*b* is set at 20 K to 40 K, for example. The high temperature end 53*a* of the second-stage cylinder 51 is set at 20 K to 40 K, for example, and the low temperature end 53*b* is set at 4 K, for example.

Operations of the GM refrigerator 1 configured as above will be described. Suppose the first-stage displacer 22 and the second-stage displacer 52 are at bottom dead centers respectively in the first-stage cylinder 20 and the second-stage cylinder 51 in a state in which the high-pressure valve 5 is closed, and in which the low-pressure valve 6 is closed.

In this state, when the high-pressure valve 5 becomes in an open state, and the valve 6 remains in a closed state, high-pressure helium gas flows from the gas compressor unit 3 into the first-stage cooling section 15. The high-pressure helium gas flows from the first-stage high-temperature-side flow paths 40-1 into an inside of the first-stage displacer 22 and is cooled to reach a certain temperature by the first-stage regenerator material 30. The cooled helium gas flows from the first-stage low-temperature-side flow paths 40-2 into the first-stage expansion chamber 31.

Some of the high-pressure helium gas having flowed into the first-stage expansion chamber 31 flows from the second-stage high-temperature-side flow path 40-3 into an inside of the second-stage displacer 52. This helium gas is cooled to a lower predetermined temperature by the second-stage regenerator material 60 and flows from the second-stage low-temperature-side flow paths 54-2 into the second-stage expansion chamber 55. As a result of these, the first-stage expansion chamber 31 and the second-stage expansion chamber 55 become in high-pressure states.

Subsequently, the first-stage displacer 22 and the second-stage displacer 52 move to top dead centers, and the high-pressure valve 5 is closed. And also, the valve 6 is opened. Hence, the helium gas in the first-stage expansion chamber 31 and the second-stage expansion chamber 55 becomes in a low-pressure state from the high-pressure state, and a volume thereof expands. As a result, a temperature of the helium gas in the first-stage expansion chamber 31 and the second-stage expansion chamber 55 is further lowered. In addition, by doing so, the first-stage cooling stage 35 and the second-stage cooling stage 85 are respectively cooled.

Subsequently, the first-stage displacer 22 and the second-stage displacer 52 move toward the bottom dead centers. Along with this, the low-pressure helium gas follows a reverse route of the above and returns via the valve 6 and the pipe 7 to the gas compressor unit 3 while respectively cooling the first-stage regenerator material 30 and the second-stage regenerator material 60. The valve 6 is thereafter closed.

The above operations are regarded as one cycle. By repeating the above operations, heat is absorbed from cooled objects (not illustrated) respectively thermally-connected to the first-stage cooling stage 35 and the second-stage cooling stage 85 to enable the cooled objects to be cooled.

<Regenerator Material>

Figure 2:
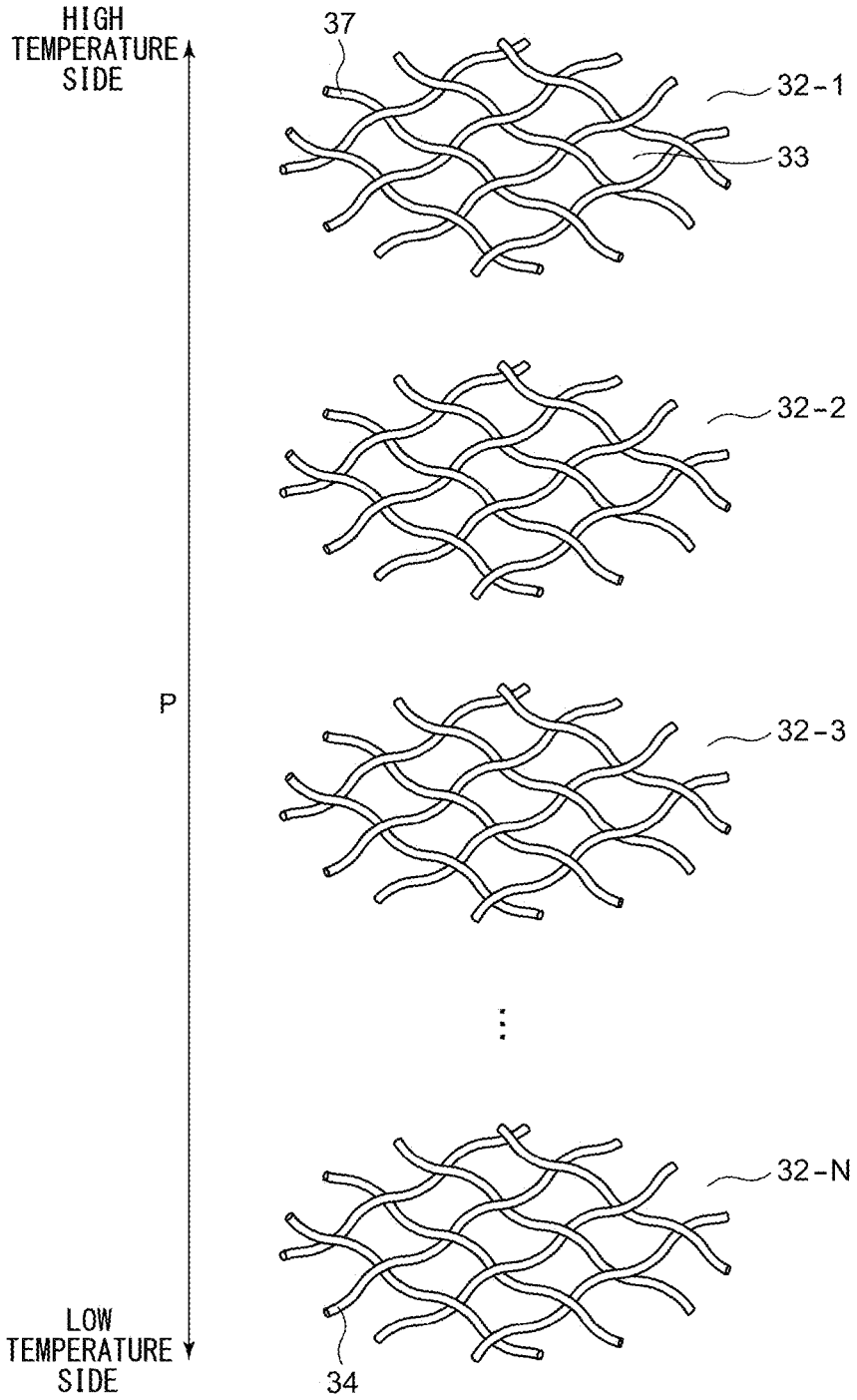
FIG. 2 is a schematic view illustrating a configuration of a first-stage regenerator material in FIG. 1.

FIG. 2 is a schematic view illustrating a configuration of the first-stage regenerator material 30. The first-stage regenerator material 30 has a laminated structure in which N (N is a natural number of at least 2) sheet-like metal meshes 32-1 to 32-N are laminated along a laminating direction P. The laminating direction P is approximately parallel to the axial direction Q of the cold head 10 or the moving direction of the first-stage displacer 22. The cold head 10 is configured so that the helium gas may move along the moving direction of the first-stage displacer 22 in the first-stage displacer 22. Thus, the laminating direction P is approximately parallel to the moving direction of the helium gas. In other words, the helium gas moves along the laminating direction P through the first-stage regenerator material 30.

Each of the metal meshes 32-1 to 32-N constituting each layer of the laminated structure is formed by weaving a wire member having a predetermined wire diameter and made of a predetermined material. A plane defined by each of the metal meshes 32-1 to 32-N constituting each layer is approximately orthogonal to the laminating direction P. When the helium gas flows along the laminating direction P through the first-stage regenerator material 30, the helium gas passes through a plurality of openings 33 of each of the metal meshes 32-1 to 32-N constituting each layer.

High-temperature-side metal meshes out of the N metal meshes 32-1 to 32-N are formed by weaving a copper or stainless steel wire member 37. Low-temperature-side metal meshes out of the N metal meshes 32-1 to 32-N are formed by weaving a different wire member 34 from the wire member 37 of the high-temperature-side metal meshes. The low-temperature-side metal meshes are metal meshes that are at 50 K or less at the time of normal operations of the GM refrigerator 1, for example.

Figure 3:
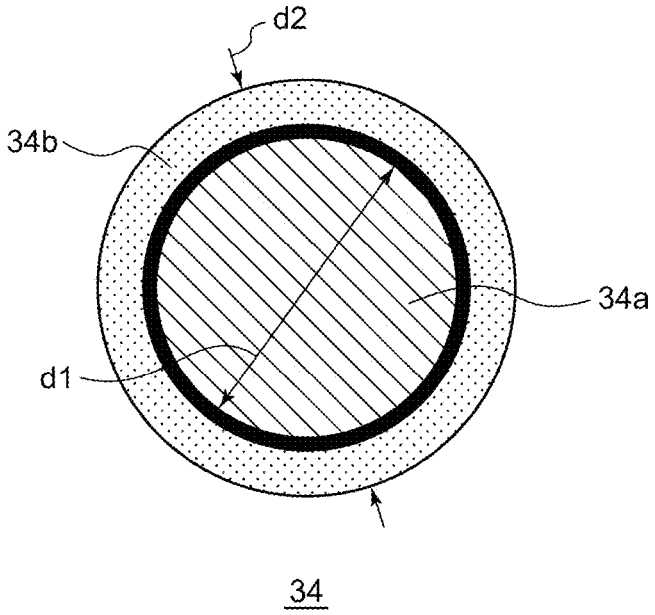
FIG. 3 is a cross-sectional view of a wire member of low-temperature-side metal meshes.

FIG. 3 is a cross-sectional view of the wire member 34 of the low-temperature-side metal meshes. The wire member 34 includes a base material 34*a* and a coating 34*b* covering the base material 34*a*. The base material 34*a* is made of a copper-based material or stainless steel. The copper-based material may be phosphor bronze, red brass, pure copper, tough pitch copper, or oxygen-free copper, for example. The coating 34*b* is made of any one of zinc, tin, silver, indium, and gold, or an alloy containing at least two out of zinc, tin, silver, indium, and gold. Especially, the coating 34*b* is formed by a plating treatment of the base material 34*a*.

Ideas in selecting materials for the base material 34*a* and the coating 34*b* are as follows.

(1) To make volumetric specific heat of the coating 34*b* larger than volumetric specific heat of the base material 34*a* in a temperature range from 20 K to 40 K. Also, to make volumetric specific heat of the coating 34*b* at 50 K larger than volumetric specific heat of the base material 34*a* at 50 K.

Figure 4A:
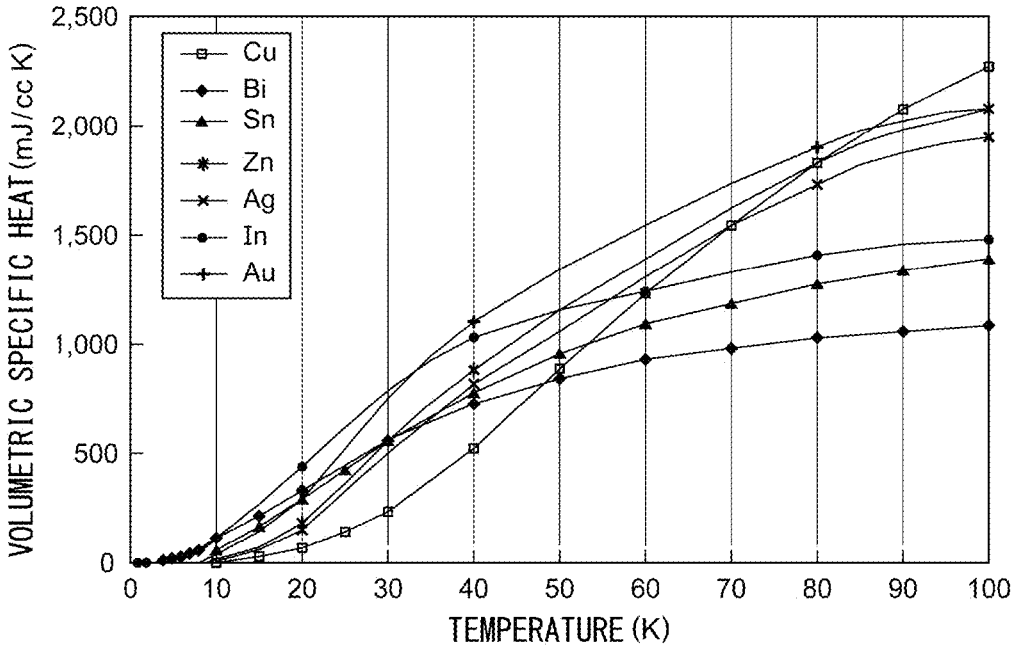
FIGS. 4A and 4B are graphs each illustrating relationship between volumetric specific heat and a temperature of each of various metals.
Figure 4B:
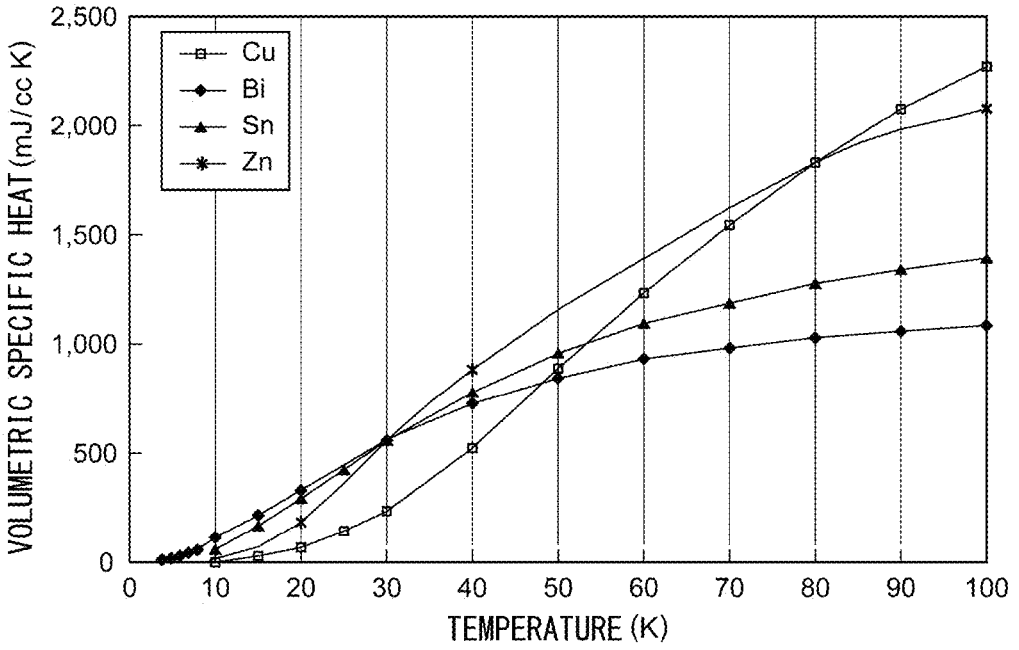

FIGS. 4A and 4B are graphs each illustrating relationship between volumetric specific heat and a temperature of each of various metals. Referring to these graphs, respective volumetric specific heat of zinc, tin, silver, indium, and gold is larger than volumetric specific heat of copper in the temperature range from 20 K to 40 K. And also, respective volumetric specific heat of zinc, tin, silver, indium, and gold at 50 K is larger than volumetric specific heat of copper at 50 K, and volumetric specific heat of bismuth at 50 K is smaller than volumetric specific heat of copper at 50 K.

(2) To make heat conductivity of the base material 34*a* larger than heat conductivity of the coating 34*b* in the temperature range from 20 K to 40 K.

(3) To make malleability or ductility or both (that is, malleability-and-ductility) of the coating 34*b* higher than that of bismuth. Malleability-and-ductility is a kind of mechanical property (plasticity) of a solidmaterial and represents a limit of an ability of a material to be flexibly deformed without fracture. Malleability-and-ductility is classified into malleability and ductility. In materials science, ductility is especially an ability of a material to deform under tensile stress and is often characterized by an ability of the material to be stretched into a wire. On the other hand, malleability is an ability of a material to deform under compressive stress and is often characterized by an ability of the material to form a thin sheet by hammering or rolling. Malleability of bismuth is relatively low, and bismuth is weak in tensile stress. Conversely, zinc, tin, silver, indium, and gold have relatively high malleability and ductility.

The coating 34*b* is preferably formed by tin plating. Tin is one of traditionally well-known and familiar metal materials. Molten tin plating on sheet iron is known as a tinplate, and an alloy with lead is traditionally used as solder for intermetallic connection. In recent year, with advanced improvement of plating bath, bright tin plating further excellent in brightness, solderability, and an anti-corrosion property is obtained. Hardness of tin plating is shown in the following table.

TABLE 1

| Plating type | Hardness(Hv) |
|---|---|
| Bright tin (strong acid bath) | 40~60 |
| Non-bright tin (strong acid bath) | 5~8 |
| Non-bright tin (alkali bath) | 3~4 |
| Semi-bright tin (neutral bath) | 10~15 |
| Bright tin (neutral bath) | 30~50 |

As shown in this table, hardness of bright tin is 30 to 60 Hv and is higher than that of non-bright tin, which is 3 to 8 Hv. Accordingly, forming the coating 34*b* by bright-plating the base material 34*a* with tin can increase hardness of the coating 34*b*, which is preferable.

Figure 5:
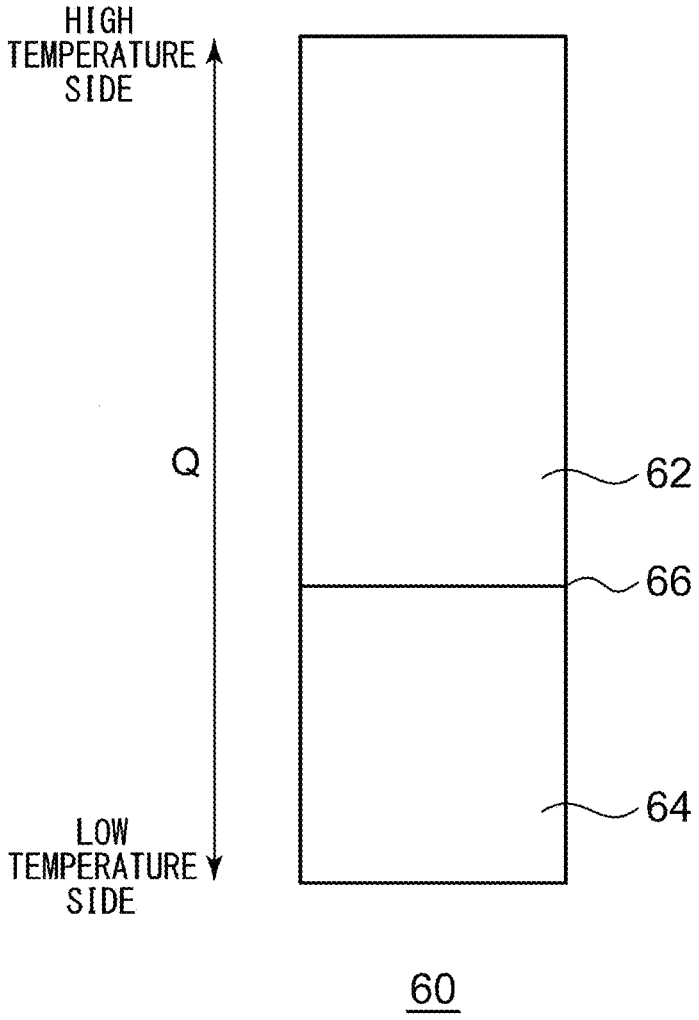
FIG. 5 is a schematic view illustrating a configuration of a second-stage regenerator material in FIG. 1.

FIG. 5 is a schematic view illustrating a configuration of the second-stage regenerator material 60. The second-stage regenerator material 60 has different configurations between a high-temperature-side part 62 and a low-temperature-side part 64. The high-temperature-side part 62 is configured in a similar manner to that of the low temperature side of the first-stage regenerator material 30. That is, the high-temperature-side part 62 has a laminated structure in which a plurality of sheet-like metal meshes are laminated along a laminating direction (that is, the axial direction Q). A wire member of each of these metal meshes includes a base material corresponding to the base material 34*a* and a coating corresponding to the coating 34*b*.

The low-temperature-side part 64 is configured to include a plurality of balls of bismuth, lead, and/or a magnetic material such as $HoCu_2$. The second-stage regenerator material 60 is configured so that a temperature of a boundary 66 between the high-temperature-side part 62 and the low-temperature-side part 64 may be approximately 10 K at the time of normal operations of the GM refrigerator 1.

With the GM refrigerator 1 including the regenerator materials 30 and 60 according to the present embodiment, specific heat of the regenerator materials 30 and 60, which are at 10 K to 50 K at the time of normal operations of the GM refrigerator 1, can be increased. Thus, a heat exchange efficiency at the regenerator materials 30 and 60 can be increased. Consequently, refrigerating capacity of the GM refrigerator 1 can be increased.

Figure 6:
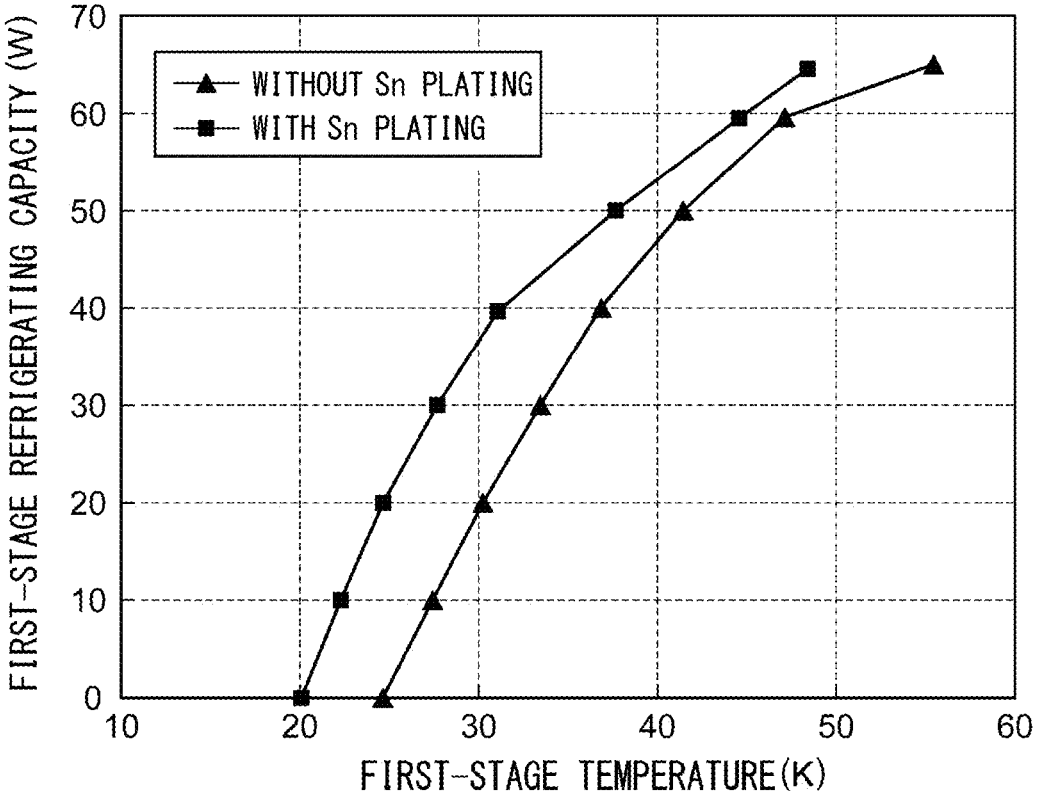
FIG. 6 is a graph illustrating relationship between a temperature of a first-stage cooling stage and refrigerating capacity actually measured in the GM refrigerator in FIG. 1.

FIG. 6 is a graph illustrating relationship between a temperature of the first-stage cooling stage 35 and refrigerating capacity actually measured in the GM refrigerator 1. In the graph illustrated in FIG. 6, black-filled triangles represent data in a case in which the metal meshes of the first-stage regenerator material are not tin-plated while black-filled squares represent data in a case in which the metal meshes on the low temperature side of the first-stage regenerator material 30 are tin-plated. It is apparent from this graph that, in a temperature range of 50 K or less, first-stage refrigerating capacity in the case with tin plating significantly exceeds first-stage refrigerating capacity in the case without tin plating. Especially, the first-stage refrigerating capacity at 40K is increased from 46.8 W in the case without plating to 53.4 W in the case with plating, which is an approximately 14% increase. And also, the first-stage refrigerating capacity at 30K is increased from 19.0 W in the case without plating to 36.4 W in the case with plating, which is an approximately 91% increase.

Figure 7:
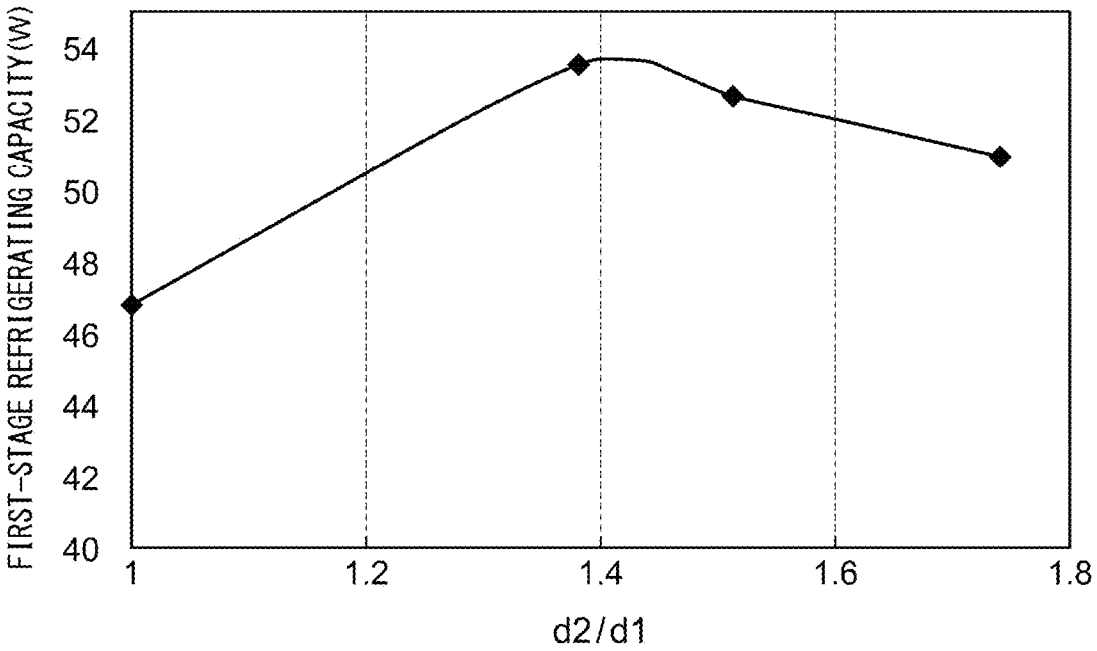
FIG. 7 is a graph illustrating relationship between the refrigerating capacity of the first-stage cooling stage at 40 K actually measured in the GM refrigerator in FIG. 1 and a ratio of diameters of the wire member.

FIG. 7 is a graph illustrating relationship between the refrigerating capacity of the first-stage cooling stage 35 at 40 K actually measured in the GM refrigerator 1 and a ratio of diameters of the wire member 34. When a diameter of the base material 34*a* on a cross-section of the wire member 34 is referred to as d1 while an outside diameter of the coating 34*b* is referred to as d2 (refer to FIG. 3), a ratio of diameters of the wire member 34 is given as d2/d1. The refrigerating capacity draws a peak with d2/d1=1.4 approximately at a center thereof. The reason for this is that a too thin coating 34*b* impairs the specific heat increase effect by the coating 34*b* while a too thick coating 34*b* reduces the sizes of the openings of the metal meshes to increase flow path resistance or thins the base material 34*a* to make heat conduction worse. Accordingly, it is more preferable to set d2/d1 in a range from 1.3 to 1.5 so that these influences may be balanced.

Also, in the GM refrigerator 1 including the regenerator materials 30 and 60 according to the present embodiment, heat conductivity of the base material 34*a* is larger than heat conductivity of the coating 34*b* in the temperature range from 20 K to 40 K. Thus, relatively increasing the heat conductivity of the base material 34*a* can facilitate heat conduction through the base material 34*a* and reduce a temperature difference in a radial direction (a direction orthogonal to the laminating direction P) of the regenerator materials 30 and 60. This contributes to improvement in the heat exchange efficiency at the regenerator materials 30 and 60.

That is, with the regenerator materials 30 and 60 according to the present embodiment, heat conduction as well as heat capacity of the regenerator materials 30 and 60 can be increased to reduce a temperature gradient. Meanwhile, it is preferable to adopt a material with larger heat conductivity among the copper-based materials, such as red brass, pure copper, tough pitch copper, and oxygen-free copper, which have larger heat conductivity than phosphor bronze.

Also, in the GM refrigerator 1 including the regenerator materials 30 and 60 according to the present embodiment, the coating 34*b* is made of a material relatively excellent in malleability-and-ductility. Thus, when the metal meshes are filled in the displacers 22 and 52, a possibility of breakage of the coating 34*b* of the metal meshes caused by mechanical contact, stress, a scrape, or the like can be reduced. In addition, when the regenerator materials 30 and 60 perform reciprocating movement together with the displacers 22 and 52 during normal operations of the GM refrigerator 1, a possibility of breakage of the coating 34*b* caused by vibration can be reduced.

Also, in the GM refrigerator 1 including the regenerator materials 30 and 60 according to the present embodiment, the first-stage regenerator material 30 has a laminated structure in which the N sheet-like metal meshes 32-1 to 32-N are laminated along the laminating direction P. Accordingly, a pressure loss can be reduced further than in a case of adopting a plurality of balls as a regenerator material.

The configuration and operations of the GM refrigerator 1 including the regenerator materials 30 and 60 according to the embodiment have been described above. Those skilled in the art would understand that the present embodiment is illustrative only, that various variant embodiments for combination of the respective components are available, and that such variant embodiments are within the scope of the present invention.

Figure 8:
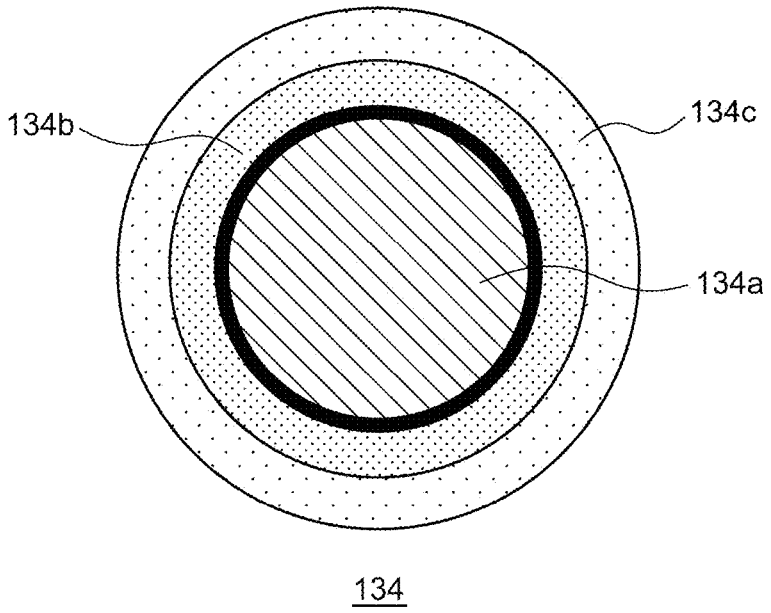
FIG. 8 is a cross-sectional view of a wire member of the metal meshes according to a first variant embodiment.

In the present embodiment, as for the wire member 34 of the low-temperature-side metal meshes among the N metal meshes 32-1 to 32-N, a case in which the coating 34*b* is an outermost layer has been described. However, the present invention is not limited to this. FIG. 8 is a cross-sectional view of a wire member 134 of the metal meshes according to a first variant embodiment. The metal mesh wire member 134 includes a base material 134*a* corresponding to the base material 34*a*, a coating 134*b* corresponding to the coating 34*b*, and a protecting layer 134*c* covering the coating 134*b*. The protecting layer 134*c* is made of bismuth, antimony, or an alloy of these. Alternatively, the protecting layer 134*c* may be made of bright tin or chromium.

With the present variant embodiment, since the relatively soft coating 134*b* is covered with the relatively hard protecting layer 134*c*, damage of the coating 134*b* can be reduced. Meanwhile, antimony or bismuth may be mixed with a material for the coating 134*b* to coat these at the same time. In this case, a volumetric mixing ratio of antimony or bismuth is preferably 0.01% to 49.99%.

Figure 9:
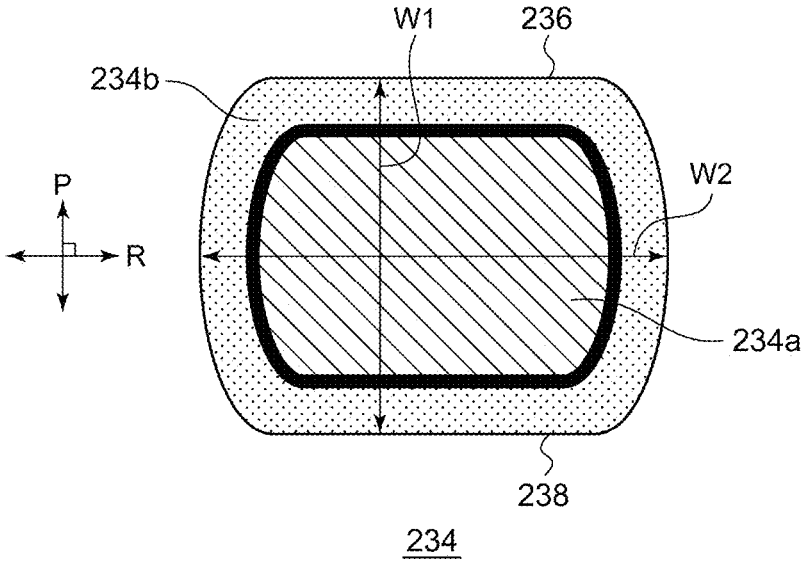
FIG. 9 is a cross-sectional view of a wire member of the metal meshes according to a second variant embodiment.

In the present embodiment, although a case in which the cross-section of the wire member 34 is isotropic or circular has been described, the present invention is not limited to this. FIG. 9 is a cross-sectional view of a wire member 234 of the metal meshes according to a second variant embodiment. The wire member 234 includes a base material 234*a* and a coating 234*b* covering the base material 234*a*. The base material 234*a* is made of a copper-based material or stainless steel. The copper-based material may be phosphor bronze, red brass, pure copper, tough pitch copper, or oxygen-free copper, for example. The coating 234*b* is made of an alloy containing any one or at least two out of zinc, tin, silver, indium, and gold.

A width W1 of the cross-section of the wire member 234 in the laminating direction P is smaller than a width W2 in an orthogonal direction R intersecting with, especially, orthogonal to, the laminating direction P in the cross-section. Especially, a surface of the wire member 234 has two flat portions 236 and 238 opposed to each other in the laminating direction P. Such a wire member 234 may be formed by rolling a base material having a circular cross-section and tin-plating the rolled base material, for example.

Figure 10:
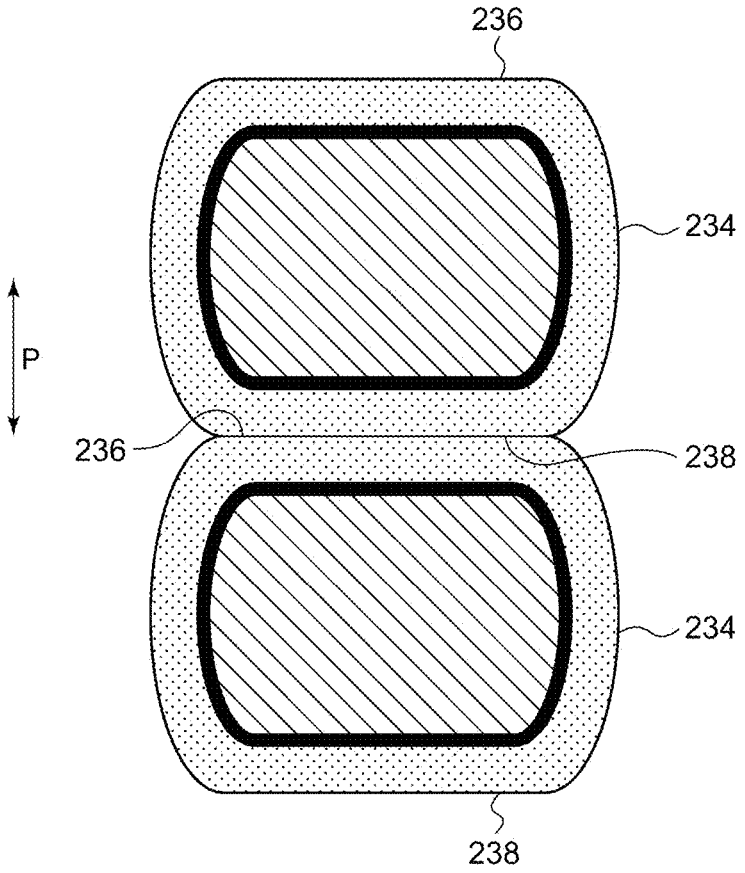
FIG. 10 is a cross-sectional view when the two metal meshes according to the second variant embodiment are laminated.

FIG. 10 is a cross-sectional view when the two metal meshes according to the second variant embodiment are laminated. When the metal meshes made of the wire member 234 are laminated along the laminating direction P, the lower flat portion 238 of the wire member 234 of the upper metal mesh is brought into contact with the upper flat portion 236 of the wire member 234 of the lower metal mesh. At this time, a contact area thereof is larger than that in a case where the cross-section of the wire member is circular, for example. Accordingly, contact stress at the time of filling can be distributed, and damage of the coating can be reduced.

In the present embodiment, although a case in which tin is used as a material for the coating 34*b*, but in which the coating 34*b* does not consist primarily of bismuth, has been described, the present invention is not limited to this. For example, the coating may be an alloy of bismuth and tin, an alloy of antimony and tin, or an alloy of bismuth, antimony, and tin.

Tin has a transition point between beta tin and alpha tin at a temperature close to a room temperature. In transition to alpha tin, malleability is lost, and at the same time, volume largely increases. Although this transition seldom progresses in a normal temperature range due to an effect of impurities or the like, the transition may progress in a frigid environment as in the Arctic region, in which case a phenomenon occurs in which a tin product is swollen and deteriorated. This phenomenon is called tin pest by an analogy to the epidemic since it starts at a part of a tin product and eventually spreads into the entirety.

Tin significantly changes a physical property thereof by this allotropic transformation. Tin physically transforms from beta tin to alpha tin at 13.2 degrees Celsius, but an actual reaction progresses in a low temperature range of −10 degrees Celsius or below, and reaction speed thereof is maximum at −45 degrees Celsius. In the present variant embodiment, the coating is formed by adding antimony, bismuth, or both as impurities to beta tin. Thus, the above allotropic transformation can be restricted. Meanwhile, a volumetric mixing ratio of antimony, bismuth, or both is preferably 0.01% to 49.99%.

In the present embodiment, although a case in which the first-stage regenerator material 30 and/or the second-stage regenerator material 60 have/has on the low temperature side different metal meshes from those on the high temperature side (that is, a case in which two kinds of metal meshes are laminated) has been described, the present invention is not limited to this. In an embodiment, the first-stage regenerator material 30 and/or the second-stage regenerator material 60 may have three or more kinds of metal meshes, and different kinds of metal meshes may be laminated in respective temperature regions.

Figure 11:
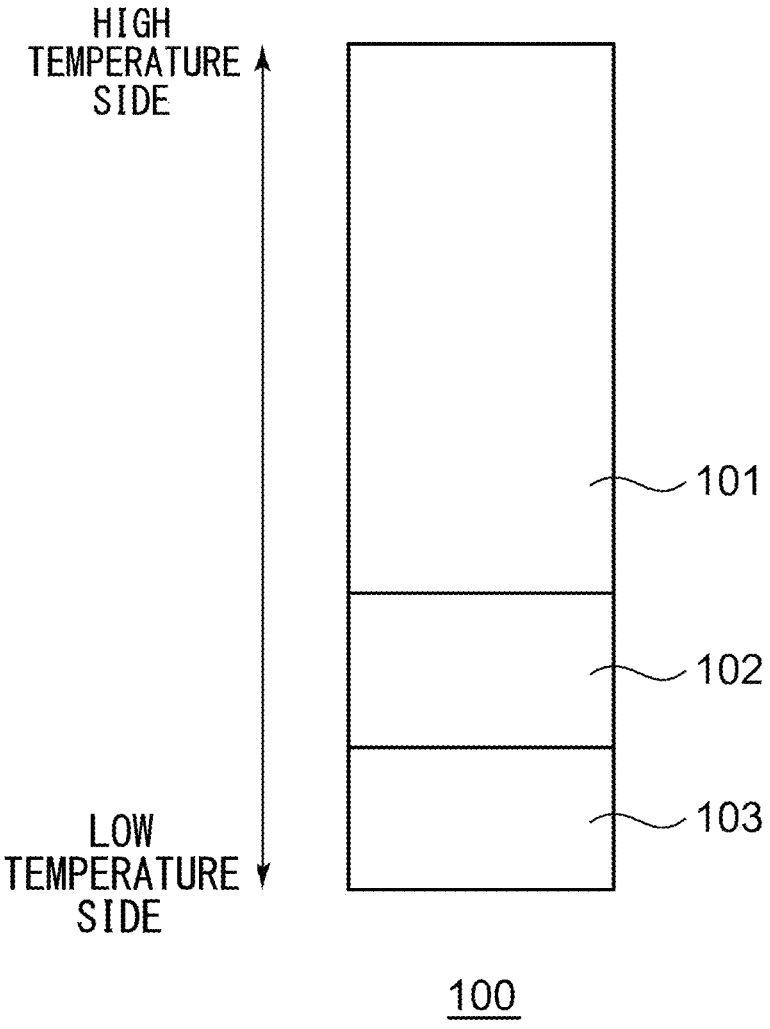
FIG. 11 is a schematic view illustrating another example of a configuration of a first-stage regenerator material.

For example, as illustrated in FIG. 11, a first-stage regenerator material 100 may include a first part 101 furthest on the high temperature side, a second part 102 at a middle temperature, and a third part 103 furthest on the low temperature side. The low temperature side of the first part 101 is adjacent to the high temperature side of the second part 102, and the low temperature side of the second part 102 is adjacent to the high temperature side of the third part 103.

Each of the first part 101, the second part 102, and the third part 103 has at least one metal mesh, or normally, a plurality of metal meshes. In the first part 101, first metal meshes made of a first wire member are laminated. Similarly, in the second part 102, second metal meshes made of a second wire member are laminated, and in the third part 103, third metal meshes made of a third wire member are laminated. The first wire member, the second wire member, and the third wire member are different from one another as several specific examples thereof will be described below, and the first metal meshes, the second metal meshes, and the third metal meshes are thus different kinds of metal meshes from one another.

The first wire member, the second wire member, and the third wire member have different volume ratios of the coating to the base material from one another. Specifically, the volume ratio is larger further on the low temperature side. For example, the metal meshes made of different kinds of wire members are laminated in the respective temperature regions so that an area ratio of the coating to the base material on a cross-section (to be precise, a cross-section by a plane perpendicular to a longitudinal direction of the wire member) of the wire member may be larger further on the low temperature side, to constitute the first-stage regenerator material 100. For example, in a case where the cross-section of the wire member is circular, the aforementioned d2/d1 is larger further on the low temperature side. Accordingly, in the first-stage regenerator material 100, further on the low temperature side, the amount of the coating material per layer is larger, and heat capacity per layer is larger. In this manner, a heat exchange efficiency on the low temperature side can be increased, and refrigerating capacity of the GM refrigerator 1 can be improved.

Figure 12A:
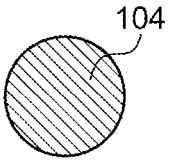
FIG. 12A, FIG. 12B, and FIG. 12C illustrate examples of a first wire member, a second wire member, and a third wire member, respectively.
Figure 12B:
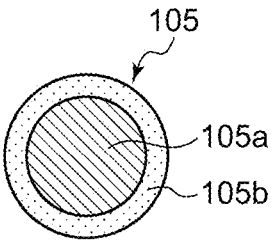
Figure 12C:
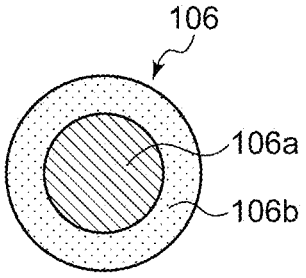

FIG. 12A, FIG. 12B, and FIG. 12C illustrate examples of a first wire member 104, a second wire member 105, and a third wire member 106, respectively. Respective cross-sections of the first wire member 104, the second wire member 105, and the third wire member 106 are illustrated.

The first wire member 104 includes a base material. The first wire member 104 does not include coating. The second wire member 105 includes a base material 105*a* and a coating 105*b* covering the base material 105*a*. The third wire member 106 includes a base material 106*a* and a coating 106*b* covering the base material 106*a*.

The first wire member 104, the base material 105*a* of the second wire member 105, and the base material 106*a* of the third wire member 106 have equal cross-sectional dimensions. Hence, the first wire member 104, the base material 105*a* of the second wire member 105, and the base material 106*a* of the third wire member 106 have equal outside diameters. On the other hand, the coating 106*b* of the third wire member 106 is thicker than the coating 105*b* of the second wire member 105. Thus, the second wire member 105 is thicker than the first wire member 104, and the third wire member 106 is thicker than the second wire member 105.

Since the third wire member 106 is thicker than the second wire member 105, openings surrounded by the wire member of the third metal meshes can be smaller than those of the second metal meshes. However, since the third metal meshes are arranged further on the low temperature side than the second metal meshes, and viscosity of helium gas on the low temperature side is low, an increase of a pressure loss in the third part 103 (and also lowering of refrigerating capacity) can be restricted. Thus, it can be thought that improvement of a heat exchange efficiency by making the coating thicker exceeds an increase of a pressure loss. Accordingly, refrigerating capacity of the GM refrigerator 1 can be improved.

Figure 13A:
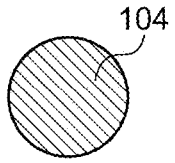
FIG. 13A, FIG. 13B, and FIG. 13C illustrate other examples of the first wire member, the second wire member, and the third wire member, respectively.
Figure 13B:
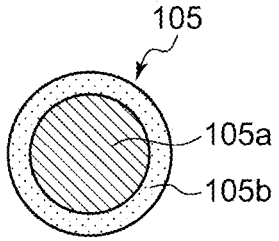
Figure 13C:
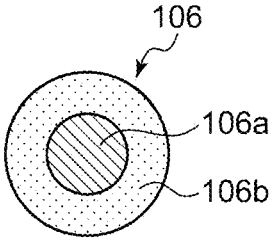

FIG. 13A, FIG. 13B, and FIG. 13C illustrate other examples of the first wire member 104, the second wire member 105, and the third wire member 106, respectively. As illustrated in the figures, while the first wire member 104 and the base material 105*a* of the second wire member 105 have equal cross-sectional dimensions, the base material 106*a* of the third wire member 106 is thinner than the base material 105*a* of the second wire member 105. Hence, the coating 106*b* of the third wire member 106 can be thicker than the coating 105*b* of the second wire member 105. And also, since the base material 106*a* of the third wire member 106 is thin, the third wire member 106 can have an equal thickness to that of the second wire member 105. Accordingly, an increase of a pressure loss in the third part 103 can be restricted further than in the example illustrated in FIG. 12C. Meanwhile, in this case, the third wire member 106 may be thicker than the second wire member 105 to make the coating 106*b* thicker.

Figure 14A:
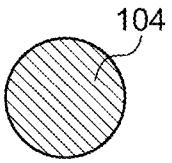
FIG. 14A, FIG. 14B, and FIG. 14C illustrate still other examples of the first wire member, the second wire member, and the third wire member, respectively.
Figure 14B:
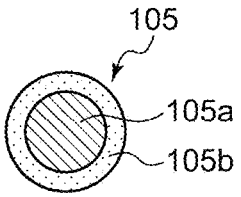
Figure 14C:
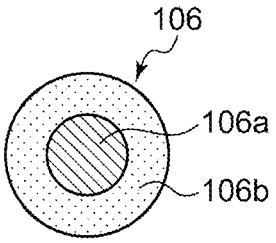

FIG. 14A, FIG. 14B, and FIG. 14C illustrate still other examples of the first wire member 104, the second wire member 105, and the third wire member 106, respectively.

As illustrated in the figures, the base material 105*a* of the second wire member 105 is thinner than the first wire member 104, and the base material 106*a* of the third wire member 106 is as thick as the base material 105*a* of the second wire member 105. By doing so, an increase of a pressure loss in the second part 102 can be restricted. In this case, the second wire member 105 may be as thick as or thicker than the first wire member 104.

In the present embodiment, although a case in which the first-stage regenerator material 30 has a laminated structure in which the N sheet-like metal meshes 32-1 to 32-N are laminated along the laminating direction P has been described, the present invention is not limited to this. For example, the first-stage regenerator material may have a laminated structure in which a plurality of metal plates provided with a plurality of holes or porous metal plates are laminated. In this case, each of the metal plates on the low temperature side may be provided with a coating by plating. The same is true of the second-stage regenerator material 60.

Although the present embodiment has been described taking the GM refrigerator 1 as an example, the present invention is not limited to this, and the regenerator material according to the present embodiment may be built in another kind of regenerative refrigerator such as a GM-type or Stirling-type pulse tube refrigerator, a Stirling refrigerator, and a Solvay refrigerator.

The GM refrigerator 1 having built therein the regenerator material according to the present embodiment may be used as a cooling means or a liquefying means in a superconducting magnet, a cryopump, an X-ray detector, an infrared sensor, a quantum photon detector, a semiconductor detector, a dilution refrigerator, an He3 refrigerator, an adiabatic demagnetization refrigerator, a helium liquefier, a cryostat, and the like.

It should be understood that the invention is not limited to the above-described embodiment, but may be modified into various forms on the basis of the spirit of the invention. Additionally, the modifications are included in the scope of the invention.

Priority is claimed to Japanese Patent Application No. 2013-129461, filed on Jun. 20, 2013 and Japanese Patent Application No. 2013-257721, filed on Dec. 13, 2013, the entire contents of which are incorporated herein by reference.

What is claimed is:

1. A regenerative refrigerator comprising:

a cold head comprising a first-stage cooling stage and a first-stage cylinder, the first-stage cooling stage provided around a low temperature end of the first-stage cylinder, the first-stage cylinder extending along an axial direction of the cold head from the low temperature end to a high temperature end, opposite to the low temperature end, of the first-stage cylinder; and a first-stage regenerator material arranged in the first-stage cylinder, the first-stage regenerator material comprising a laminated structure comprising a plurality of first porous metal layers layered along a laminating direction from the high temperature end to a first axial position between the high temperature end and the low temperature end of the first-stage cylinder and a plurality of second porous metal layers layered along the laminating direction from the first axial position to a second axial position, closer to the low temperature end than the first axial position, of the first-stage cylinder, each of the first and second porous metal layers extending along a plane perpendicular to the laminating direction, the laminating direction is parallel to the axial direction of the cold head, wherein each of the first and second porous metal layers of the laminated structure comprises a metal mesh or metal plate provided with a plurality of holes to allow gas to pass through the laminated structure along the laminating direction, wherein each of the first porous metal layers of the laminated structure includes a base material made of metal and does not include coating, wherein each of the second porous metal layers of the laminated structure includes the base material made of metal and a coating made of metal, the coating covers the base material of that second porous metal layer.

2. The regenerative refrigerator according to claim 1, wherein heat conductivity of the coating is smaller than heat conductivity of the base material in a temperature range from 20 K to 40 K.

3. The regenerative refrigerator according to claim 1, wherein volumetric specific heat of the coating at 50 K is larger than volumetric specific heat of the base material at 50 K.

4. The regenerative refrigerator according to claim 1, wherein the coating is made of any one of zinc, tin, silver, indium, and gold or an alloy containing at least two out of zinc, tin, silver, indium, and gold.

5. The regenerative refrigerator according to claim 1, wherein the base material is made of a copper-based material or stainless steel.

6. The regenerative refrigerator according to claim 1, wherein the at least one layer further includes a protecting layer covering the coating, and the protecting layer is made of bismuth, an alloy of bismuth, antimony, or an alloy of antimony.

7. The regenerative refrigerator according to claim 1, wherein the coating is formed by bright-plating the base material with tin.

8. The regenerative refrigerator according to claim 1, wherein the at least one layer has a mesh-like structure comprising a wire member, and a width of a cross-section of the wire member in the laminating direction is smaller than a width of the cross-section of the wire member in an intersecting direction intersecting with the laminating direction.

9. The regenerative refrigerator according to claim 8, wherein a surface of the wire member in the at least one layer has two flat portions opposed to each other in the laminating direction.

10. The regenerative refrigerator according to claim 1, wherein the at least one layer has a mesh-like structure comprising a wire member comprising the base material and the coating, and a value of d2/d1, where d2 represents an outside diameter of the coating and d1 represents a diameter of the base material on a cross-section of the wire member, is in a range from 1.3 to 1.5.

11. The regenerative refrigerator according to claim 1, wherein at least one layer on a low temperature side of the laminated structure has a larger volume ratio of the coating to the base material compared to at least one layer on a high temperature side of the laminated structure.

12. The regenerative refrigerator according to claim 1, wherein the base material of at least one layer on a low temperature side of the laminated structure has an equal cross-sectional dimension to that of the base material of at least one layer on a high temperature side of the laminated structure, and the coating of the at least one layer on the low temperature side is thicker than the coating of the at least one layer on the high temperature side.

13. The regenerative refrigerator according to claim 1, wherein the base material of at least one layer on a low temperature side of the laminated structure is thinner than the base material of at least one layer on a high temperature side of the laminated structure.

14. The regenerative refrigerator according to claim 12, wherein a wire member in the at least one layer on the low temperature side is as thick as or thicker than a wire member in the at least one layer on the high temperature side.

15. The regenerative refrigerator according to claim 1, wherein the regenerator material is mounted in the cold head with the coating on adjacent porous metal layers being in contact with each other.

16. The regenerative refrigerator according to claim 1, wherein volumetric specific heat of the coating is larger than volumetric specific heat of the base material in a temperature range from 20 K to 40 K.

17. The regenerative refrigerator according to claim 1, wherein volumetric specific heat of the coating is larger than volumetric specific heat of the base material in a temperature range from 20 K to 40 K, except a case in which the coating consists primarily of bismuth.

18. The regenerative refrigerator according to claim 1, wherein the cold head further comprises a first-stage displacer arranged within the first-stage cylinder to enable axial reciprocating movement along the first-stage cylinder, the first and second porous metal layers are filled in the first-stage displacer.

19. A regenerative refrigerator comprising:

a two-stage cold head comprising a second-stage cooling stage and a second-stage cylinder, the second-stage cooling stage provided around a low temperature end of the second-stage cylinder, the second-stage cylinder extending along an axial direction of the cold head from the low temperature end to a high temperature end, opposite to the low temperature end, of the second-stage cylinder; and a second-stage regenerator material arranged in the second-stage cylinder, the second-stage regenerator material comprising a laminated structure comprising a plurality of porous metal layers layered along a laminating direction from the high temperature end to an intermediate axial position between the high temperature end and the low temperature end of the second-stage cylinder and a plurality of balls arranged in a volume from the intermediate axial position to the low temperature end of the second-stage cylinder, each porous metal layer extending along a plane perpendicular to the laminating direction, the laminating direction is parallel to an axial direction of the cold head, wherein each porous metal layer of the laminated structure comprises a metal mesh or metal plate provided with a plurality of holes to allow gas to pass through the laminated structure along the laminating direction, wherein each porous metal layer of the laminated structure includes a base material made of metal and a metal coating made of metal, the metal coating covers the base material.

20. The regenerative refrigerator according to claim 1, wherein the cold head further comprises a second-stage cooling stage and a second-stage cylinder, the second-stage cooling stage provided around a low temperature end of the second-stage cylinder, the second-stage cylinder extending along the axial direction of the cold head from the low temperature end to a high temperature end, opposite to the low temperature end, of the second-stage cylinder, the regenerative refrigerator further comprises a second-stage regenerator material arranged in the second-stage cylinder, the second-stage regenerator material comprising a laminated structure comprising a plurality of porous metal layers layered along a laminating direction from the high temperature end to an intermediate axial position between the high temperature end and the low temperature end of the second-stage cylinder and a plurality of balls arranged in a volume from the intermediate axial position to the low temperature end of the second-stage cylinder, wherein each porous metal layer of the laminated structure comprises a metal mesh or metal plate provided with a plurality of holes to allow gas to pass through the laminated structure along the laminating direction, wherein each porous metal layer of the laminated structure includes a base material made of metal and a metal coating made of metal, the metal coating covers the base material.

21. A regenerative refrigerator comprising:

a cold head comprising a first-stage cooling stage and a first-stage cylinder, the first-stage cooling stage provided around a low temperature end of the first-stage cylinder, the first-stage cylinder extending along an axial direction of the cold head from the low temperature end to a high temperature end, opposite to the low temperature end, of the first-stage cylinder; and a first-stage regenerator material arranged in the first-stage cylinder, the first-stage regenerator material comprising a laminated structure comprising a plurality of first porous metal layers layered along a laminating direction from the high temperature end to a first axial position between the high temperature end and the low temperature end of the first-stage cylinder and a plurality of second porous metal layers layered along the laminating direction from the first axial position to a second axial position, closer to the low temperature end than the first axial position, of the first-stage cylinder, each of the first and second porous metal layers extending along a plane perpendicular to the laminating direction, the laminating direction is parallel to the axial direction of the cold head, wherein each of the first and second porous metal layers of the laminated structure comprises a metal mesh or metal plate provided with a plurality of holes to allow gas to pass through the laminated structure along the laminating direction, wherein each of the first porous metal layers of the laminated structure includes a base material made of metal and does not include coating, wherein each of the second porous metal layers of the laminated structure is provided with the base material made of metal and a coating covering the base material of that second porous metal layer, wherein the coating is made of an alloy of bismuth and tin, an alloy of antimony and tin, or an alloy of bismuth, antimony, and tin.

22. The regenerative refrigerator according to claim 21, wherein the regenerator material is mounted in the cold head with the coating on adjacent porous metal layers being in contact with each other.

23. The regenerative refrigerator according to claim 21, wherein volumetric specific heat of the coating is larger than volumetric specific heat of the base material in a temperature range from 20 K to 40 K.

24. The regenerative refrigerator according to claim 19, wherein the cold head further comprises a second-stage displacer arranged within the second-stage cylinder to enable axial reciprocating movement along the second-stage cylinder, the porous metal layers and the balls are filled in the second-stage displacer.

* * * * *